United States Patent [19]

Malik

[11] 4,004,806

[45] Jan. 25, 1977

[54] APPARATUS FOR COLLECTING BALLS

[76] Inventor: Stanislaus Malik, Taelesbahnstrasse 24, 7340 Geislingen, Germany

[22] Filed: June 26, 1975

[21] Appl. No.: 590,510

[30] Foreign Application Priority Data

June 27, 1974 Germany ..... 2430916

[52] U.S. Cl. ..... 273/29 R; 104/155; 302/64; 273/11 R; 273/73 C; 273/73 J; 124/34; 124/61

[51] Int. Cl.[2] ..... A63B 61/00

[58] Field of Search ..... 273/11 R, 29 R; 198/1; 104/155, 172 B, 154; 302/64

[56] References Cited

UNITED STATES PATENTS

| | | | |
|---|---|---|---|
| 3,318,262 | 5/1967 | Ganzinotti | 104/155 |
| 3,687,083 | 8/1972 | Brown | 104/155 |
| 3,697,071 | 10/1972 | Anderson | 104/155 |
| 3,848,541 | 11/1974 | Hondzinski | 198/1 X |

*Primary Examiner*—Richard C. Pinkham
*Assistant Examiner*—T. Brown
*Attorney, Agent, or Firm*—Bacon & Thomas

[57] ABSTRACT

Disclosed is an apparatus for collecting balls from a playing area, preferably tennis balls, comprising a channel surrounding at least a portion of the playing area for receiving balls rolling out of the playing area, a device of relatively high weight in comparison to one of the balls, adapted for rolling transport in the channel, such as a steel ball or roller, means for driving the rolling device along in the channel in order to pick up balls received in the channel, a collecting device for the balls which are picked up, and preferably, a device for propelling the balls back into the playing area.

22 Claims, 12 Drawing Figures

APPARATUS FOR COLLECTING BALLS

BACKGROUND OF THE INVENTION

The present invention pertains to a device for collecting balls from a playing area, and more especially, to an apparatus for collecting tennis balls from a tennis playing area.

In connection with a great number of games, in particular tennis, the players must spend a considerable amount of time chasing after balls which roll out of the playing area. This is not only inconvenient and perhaps distracting insofar as the game itself is concerned, but also this practice is time consuming, a fact which is especially relevant in connection with the game of tennis, since tennis facilities are always in heavy demand. In fact, in many instances today tennis courts are rented by the players on an hourly basis, and therefore, efficient use of the allotted playing time is extremely important.

In the foregoing regard, it would be extremely convenient as well as economically beneficial to have available a system which would automatically return stray balls to the playing area.

SUMMARY OF THE INVENTION

It is therefore an object of the present invention to provide an apparatus for collecting balls, such as tennis balls and the like.

It is also an object of the present invention to provide an apparatus for the collection of tennis balls and also for returning such balls to the playing area so that the progress of the game is not disturbed.

A further object of the present invention resides in a provision of an apparatus for collecting as many balls as possible which roll out of the playing area, and especially those balls which cannot be reached by one of the players.

It is also an object of the present invention to provide such an apparatus which, above all, is simple to place in operation and which can be operated substantially maintenance free.

Another object of the present invention resides in the provision of such an apparatus which can be installed in such a manner that it does not disturb the game being played, but yet that the system is easy to install.

In accomplishing the foregoing objects, there is provided in accordance with the present invention an apparatus for collecting balls from a playing area, advantageously tennis balls, the apparatus comprising a. a channel surrounding at least a portion of the playing area for receiving balls rolling out of the playing area;

b. a device of relatively high weight in comparison to one of the balls being collected, the device being capable of rolling transport in the channel, as for example, a spherical device or a travelling carriage having rollers;

c. means for driving the rolling device along in the channel, whereby balls received in the channel will likewise be driven therealong, advantageously, a flexible tube positioned in the channel coupled with a compressor or the like for selectively inflating the tube; and d. means such as at least one ball deposit location in connection with the channel for collecting the balls which are being driven along the channel by the rolling device.

Most preferably, the apparatus also includes a device for automatically returning the collected balls to the playing area, as for example, a selectively operated ball throwing or propelling device associated with the ball collection deposit area. The ball return device is advantageously actuated by remote control means, for example, either a switching device located near the playing area or a wireless radio signal control device carried by one or more players, or more advantageously, built into a playing racket.

Other objects, features and advantages of the invention will become apparent from the following detailed description of several embodiments of the invention, when considered together with the appended drawings.

DETAILED DESCRIPTION OF PREFERRED EMBODIMENTS

The above delineated problems facing the prior art are overcome in accordance with the present invention by virtue of the fact that, around a tennis or other playing area or around a part of such a playing area there is arranged a channel for receiving balls which roll out of the playing area. In this channel, a rolling device having a relatively high weight in comparison to the weight of a tennis ball runs along the top of a flexible tube which is acted upon with pressure on one side of the rolling device, and by means of this action is driven. The rolling device thereby collects all of the tennis balls lying in the channel and deposits them in a ball deposit location arranged at one point along the channel.

The apparatus of the invention encompasses the vast majority of all tennis balls which are not reachable by a player during the game. These balls roll outside of the boundary of the actual playing surface and would normally have to be retrieved from this location by hand. The circulating rolling device then deposits the tennis balls at the ball deposit location, where they may once again be taken up for playing.

The indicated construction of the apparatus according to the present invention is also particularly easy to install. It is necessary to merely arrange one or more channels around the playing area. In this regard, it turns out to be advantageous, above all, that driving the rolling device by means of a flexible tube which is activated on one side of the rolling device with pressure is maintenance free, and not susceptible to either weathering or fouling by dirt. Moreover, the apparatus is easy to install, a fact which is not the case with other arrangements, such as with tow lines driven with motors over rollers, which would lead instead to complicated adjustment, drainage and maintenance problems.

Figure 1:
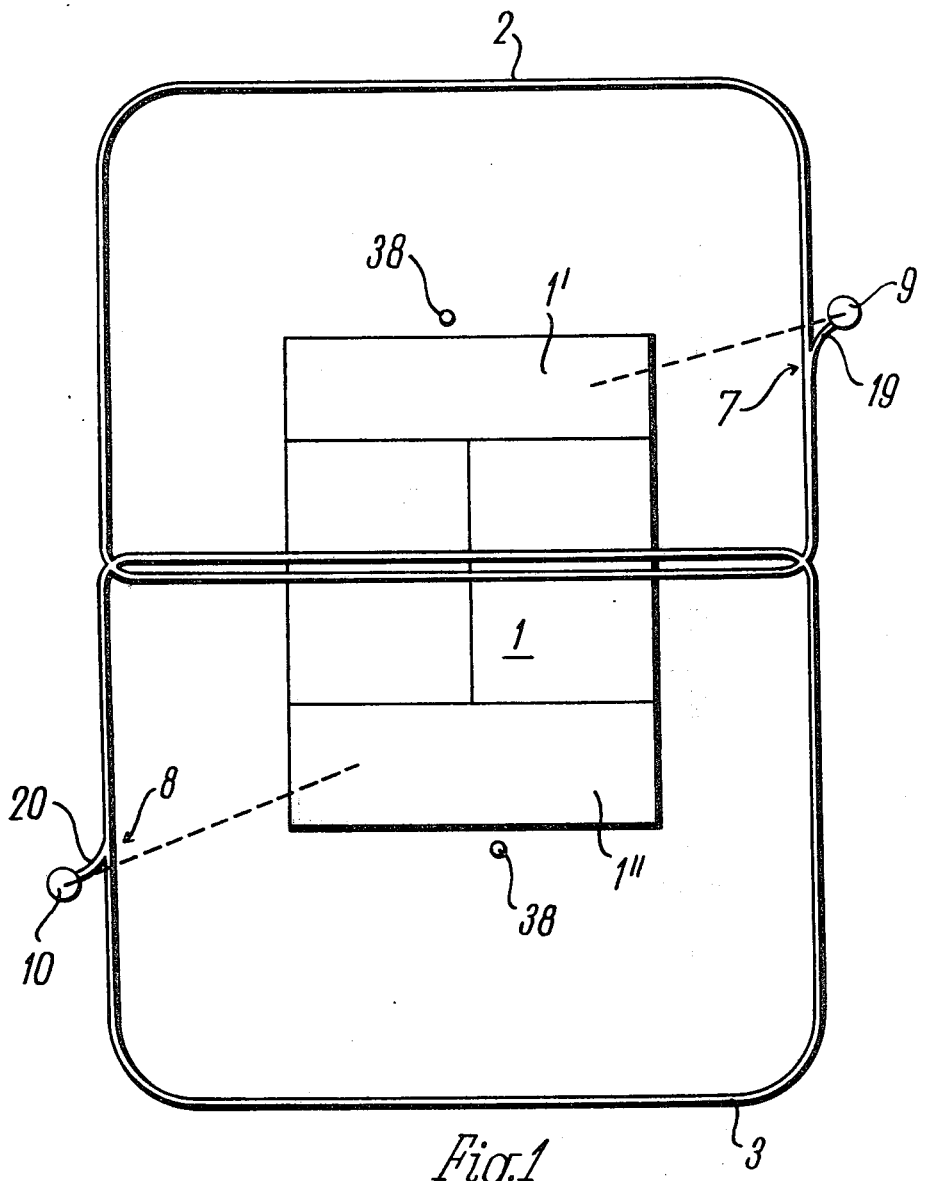
FIG. 1 is a schematic top view of a tennis playing area embodying a first embodiment of the apparatus according to the present invention

Referring now to the drawings, FIG. 1 shows via a top view a tennis playing area having a playing court 1. The two halves of the tennis court 1' and 1'', which have been mentioned hereinabove as partial areas of the tennis playing area, are surrounded respectively with channels 2,3, which are represented schematically in FIG. 1 merely in the form of dual lines. These channels form essential components of the apparatus for collecting tennis balls which, during play on the playing area, roll out of the court and/or out of the respective half court sections. The channels 2,3 receive the tennis balls which roll out of the court.

Specific embodiments of these channels are illustrated in cross section and longitudinal section, respectively, in FIGS. *3a*, *3b* and FIGS. *4a*, *4b* and FIGS. *5a*, *5b*.

Figure 2:
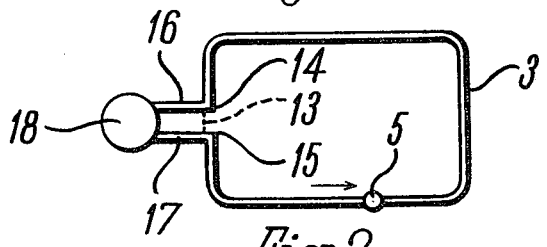
FIG. 2 is a schematic operation diagram for one loop of the embodiment shown in FIG. 1.

In accordance with FIGS. *3a* and *3b*, one of the channels, e.g., the channel 2, is formed from a contoured tracklike border circumscribing the partial area of a tennis court. The channel with its planar lower surface lies flush on every type of terrain which surrounds the tennis courts and, if necessary, can be fastened to this terrain with simple means. The channel 2 possesses in cross section an arcuate rolling surface 4. This surface has two functions: Firstly, there rolls therein a heavy ball 5, e.g., of steel or iron, which has been referred to above as a rolling device. Secondly, the tennis balls which roll out of the playing court, or part of the playing court, are received by this arcuate surface. In FIG. *3b*, the tennis ball 6 is identified as one of such tennis balls. The heavy ball, which is driven along the channel 2 on the rolling surface 4 in the direction of the arrow indicated in FIG. *3b*, pushes one or more tennis balls 6 in front of it and thereby collects them. At a particular place along the channel 2, for example, the positions 7 and 8 according to FIG. 2, the tennis balls 6 are then given up to a ball deposit location 9 or 10. Driving of the heavy ball 5, which serves as the rolling device in connection with this embodiment, takes place in the following manner: There is provided in the rolling surface 4 of channel 2 a slot-like recess 11. In it lies a flexible tube 12. Now, as may be seen from FIG. *3b*, if this tube 12 is acted on with air pressure on one side of the position of the heavy ball 5, e.g., on the right side in FIG. *3b*, the tube expands with the tendency to take on a circular cross section, and the tube thus exerts a force on the ball on the side of the tube 12 which has been acted upon with the air pressure. The force is in the direction of the arrow shown in FIG. *3b*, and the force drives the ball in the direction of this arrow. It is necessary for this mode of driving that the ball 5 is heavy enough to not be lifted as a result of applying air pressure to one side of the tube 12. If such a lifting does not take place because of the corresponding weight of the ball 5, then the ball rolls in the direction of the tube 12 which has no air pressure applied thereto. In the no-pressure condition, the tube 12 has the form shown in FIG. *3a*, which is also indicated again in cross section in FIG. *3b* and is identified with A. In the condition where air pressure has been applied, the tube 12 has the cross section identified with the letter B in FIG. *3b*.

Figure 3A:
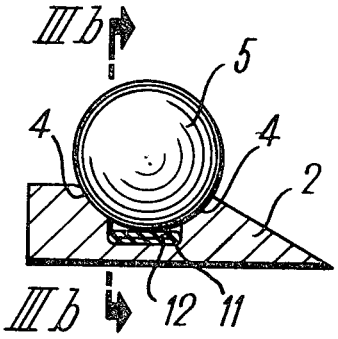
FIG. 3*a* is a cross sectional view through a first embodiment of the channel of the apparatus according to FIG. 1.
Figure 3B:
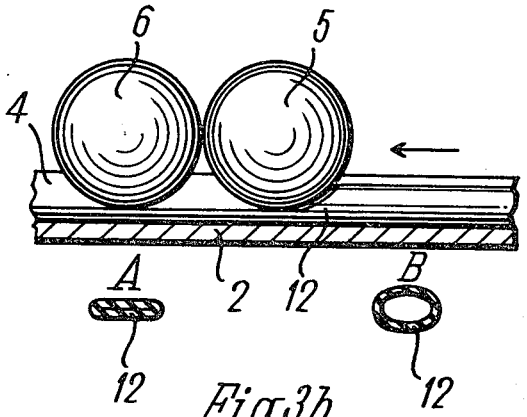
FIG. 3*b* is a cross sectional view along the line III*b*-III*b*in FIG. 3*a;*

A continuous circulation of the heavy ball 5 during operation is made possible in the following manner. The channels 2 and 3 each possess sections 13 (as is shown for the channel 3 in FIG. 2) along which the tube 12 is not arranged in the channel. Rather, the tube ends at the positions 14 and 15, which at the same time represent the bounds of section 13. At these positions 14 and 15, the tube 12 is provided with connections 16 and 17, which lead to an air compressor and vacuum device. Let it be assumed that the tube 12 is devacuated (compare the cross section according to FIG. 3a or according to FIG. 3b in the position A.), and that the ball 5 is located in the position shown in FIG. 2. Then, if the tube 12 is acted upon with air pressure via the connection 17 from the air compressor and vacuum device 18, which then functions as an air compressor device, first the part of the tube 12 to the left of the indicated position is filled with air, it exerts a force on the ball 5 and drives the ball 5 in the direction of the illustrated arrow in the above described manner. The ball 5 then circulates counterclockwise around the channel 3. During operation as an air compression device, the combination air compressor and vacuum device can be constructed as any type of conventional pressure source, e.g., pressure supply vessel or a booster pump.

In connection with this movement of the ball, when the ball 5 has then reached the position 14, it travels into the section 13, in which no tube 12 is arranged, and therefore, in which there is no driving force. However, since the introduction of air pressure is adjusted so that the ball 5 has a speed of between about 0.5 and 1.5 meters/second, the kinetic energy of the ball is sufficient in order that the ball can pass over the section 13 even without any driving force. Furthermore, a decrease in the speed of the ball 5 in the section 13 does not result in any disadvantages.

During the time which the ball 5 requires to pass over the section 13, the tube 12 in the channel 3 is evacuated by the air compression and vacuum device which at this point functions as an air pressure evacuation device. This can be accomplished by providing that a low pressure source, e.g., a low pressure storage vessel or a vacuum pump, is connected. The evacuation can take place both from the position 14 as well as from the position 15, or at both positions. Then, the ball 5 arrives at the position 15, and thus, on that portion of the channel 3 which is covered with a tube 12, and the driving sequence begins over again. The length of the section 13 is dependent upon various parameters, for example, upon the magnitude of the low pressure source which is connected during the evacuation procedure, upon the operating speed during the activation of the tube 12 with air pressure, upon the cross section of the tube, upon the particular pressures which are employed, etc. This length can be correspondingly varied over a wide range, e.g., between 0.2 and 2 meters. If desired, the section 13 can be tilted somewhat, so that the forward movement of the ball 5 over this section is thereby facilitated.

Before describing the further specific embodiments for the channel 2 or 3 with reference to the FIGS. 4*a*, 4*b* and 5*a*, 5*b*, as well as the rolling device, there will first be described in the following paragraphs, with reference to FIGS. 6*a* and 6*b*, the delivery of the tennis balls 6 to the ball deposit locations which are merely identified schematically with reference numerals 9 and 10 in FIG. 1.

The ball deposit locations 9 and 10 are constructed in principal from large containers, in which many tennis balls 6 can be collected together. To these locations lead channels 19 and 20, respectively, which are inclined somewhat away from the respective channels 2 and 3 and which are schematically illustrated in FIGS. 6*a* and 6*b*. At the position at which the channels 19 and 20 intersect with the channels 2 and 3, the cross section of the channels 2 and 3 is formed in somewhat of a different manner than the cross section according to FIGS. 3 through 5. As may be seen in FIGS. 6*a* and 6*b* for the channel 2, the sidewalls 21 and 22 are extended upwardly somewhat, so that a U-shaped cross section results. On the respective side on which the channels 19, 20 connect, therefore according to FIG. 6*a* on the left side, a recess or slit, e.g., of a length of about 20 cm., is positioned in the sidewall 22. The slit is bounded by the two side surfaces 24 and 25. From the slit 24 in the sidewall 22 over to the position 26 on sidewall 21, which lies opposite the side surface 25 of the recess 23, there extends diagonally or obliquely a rubberband 27. The rubberband runs, therefore, from the far side surface 24 of the recess 23 (taken in the direction of movement of the ball 5 and of the tennis balls 6 being pushed in front of the ball 5) diagonally to a fastening position situated further back on the sidewall 21 lying opposite the recess 23 (again referencing the direction of movement of the ball 5). The direction of movement of the ball 5 (in FIGS. 6*a* and 6*b*) is not indicated; however, the path of the tennis ball 6 is shown in FIG. 6 by means of the illustrated arrow.

Figure 6A:
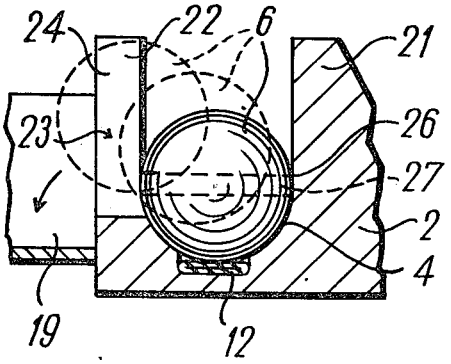
FIG. 6*a* is a cross sectional view through the channel at the position of the ball deposit location.

As may be seen from FIG. 6*a*, this rubberband 27 is arranged so that it is positioned approximately beneath a planar surface which runs parallel to the floor of the channel through the center of a tennis ball 6.

The manner of operation is as follows: If by means of a ball 5 a tennis ball 6 is pushed into the region of the channel 2 in which one sidewall is provided with a recess and on which, in addition, a rubberband 27 is arranged in the manner described hereinabove, then the rubberband is actually somewhat elastically deformed, as is shown by means of the dashed lines in FIG. 6*b*. However, as can be seen in both FIGS. 6*a* and 6*b*, the rubberband lifts the tennis ball 6, which of course has a relatively light weight, out of the channel 2 and out through the recess 23 into the channel 19.

As for the rubberband 27, it is nothing more than a common ordinary rubberband, for example, one having a width of between about 5 and 15 mm. and a thickness of about 1 to 2 mm. The elasticity of the material and stretching in the normal condition may be optimally evaluated quite easily by simple test procedures.

By means of the ball 5, which is very heavy in comparison to the weight of the tennis ball 6, the elastic rubberband 27 arranged in the manner described above is pressed onto the floor of the channel 2 or onto the running surface 4 of the same, so that the ball 5 can travel on in the channel 2 uneffected by the rubberband. This happens, of course, after the tennis balls have been delivered into the channel 19.

Figure 7:
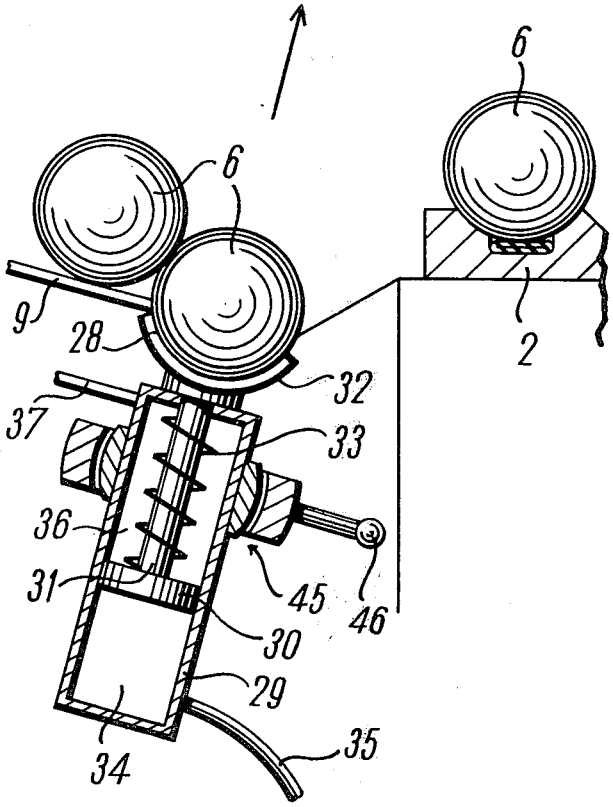
FIG. 7 is a cross sectional view through one embodiment of the ball deposit location of the apparatus according to FIG. 1, illustrating the ball propelling device provided therein.

The channel 2 leads to ball deposit locations 9 and 10, as has already been schematically discussed with reference to FIG. 1. FIG. 7 illustrates a ball propelling device, which is in the position to throw the balls out from this location in such a manner that they can be caught or received by a player.

In FIG. 7 there is illustrated the ball deposit location 9, in which several tennis balls are resting. The deposit location has an arcuate depression 28, the diameter of which is somewhat smaller than the diameter of a tennis ball 6, and which is positioned at the lowest point of the deposit location 9, so that, if a tennis ball 6 is present in the deposit location 9, this ball will come to rest in this depression.

The actual propelling or throwing device is formed from a piston 30 arranged in a cylinder 29. On the upper side of the piston rod 31 there is arranged a propelling piece 32. The piston 30 is biased downwardly by means of spring 33. The operation of the propulsion device is accomplished pneumatically, in connection with which the space 34 beneath the piston 30 is acted upon with pressure via the air introduction pipe 35 in order to propel a ball with the device. Thus, the ball, which rests immediately upon the propelling member 32, is propelled out of the device in the direction of the illustrated arrow. The next ball 6 falls into the depression 28 and by acting upon the space 34 with air pressure via the pipe 35, it too can be next propelled out of the ball deposit location. After propulsion of a ball, it is also possible to introduce air pressure into the space 36 via a line 37 in order to supplement the force of the spring 33. The air pressure control is accomplished by means of corresponding valves in a manner known per se, so that further illustration of the pneumatic portion of this arrangement, over and above that already provided, can be dispensed with. Essential for this further embodiment of the invention, however, is that the tripping of the propulsion device (introduction of air pressure into the space 34) can be accomplished by means of an operating knob 38, which is provided in the floor or surface of the tennis court in the vicinity and just outside of the boundaries of the court, so that the knob can be easily activated by having a player step thereupon. The switching mechanism can be provided under the surface of the tennis court.

Figure 8:
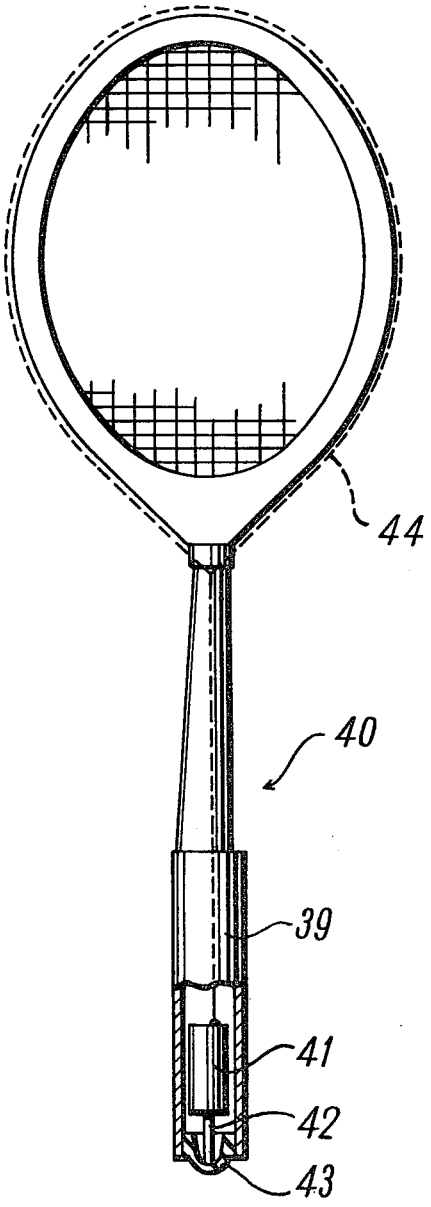
FIG. 8 is a plan view of one embodiment of a tennis racket containing a radio transmitter for activation of the ball propelling device illustrated in FIG. 7.

Alternatively to this activation of the propulsion device according to FIG. 7 by means of an activated knob 38, the activation of the propulsion device can be accomplished by means of a radio transmitter built into one or more tennis rackets. This further embodiment of the invention is illustrated in FIG. 8. In the handgrip 39 of the tennis racket 40 there is provided a radio transmitter 41 which can be switched on by means of a pressure activating pin 42. The pressure activating pin 42 terminates on an elastic rubber cap 43. Therefore, if the player hits, for example, the end of the hand grip 39 on which the elastic rubber cap 43 is provided on his thigh or hits against the rubber cap 43 with his hand, then the pressure actuating pin 43 is activated and switches the transmitter on. The transmitter is constructed in such a manner that it gives out a specific signal which is transmitted without wires and is picked up by an antenna connected to an electrical switching device which responds to this signal by introducing air pressure into the space 34 of the propulsion device.

The electronic details of construction of switching devices of this type and of the transmitter are well known. They do not deviate from the conventional construction of signal transmitting devices of this type, so that, apart from the accomodation to this special area of utility with respect to size and operating conditions, no special explanations are required. It is to be mentioned, though, that the transmitter antenna can be formed in the shape of a thin wire loop, which in FIG. 8 is passed around as wire loop 44 inside the handgrip 39 to the striking surface of the racket then around the outside of the surface (illustrated with dashed lines).

The propulsion device of the device shown in FIG. 7 can be adjusted by virtue of the fact that the cylinder 29 is locked suitably in a ball segment socket 45 with the help of a binder 46.

FIGS. 4 and 5 illustrate alternative forms of operation.

Figure 4A:
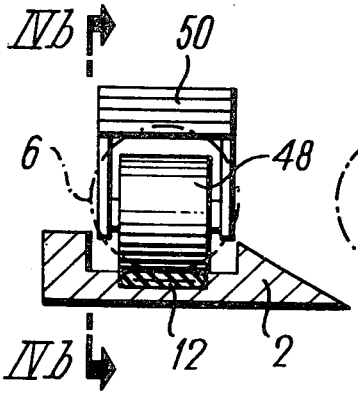
FIG. 4*a* is a cross sectional view through a second embodiment of the channel of the apparatus according to FIG. 1.
Figure 4B:
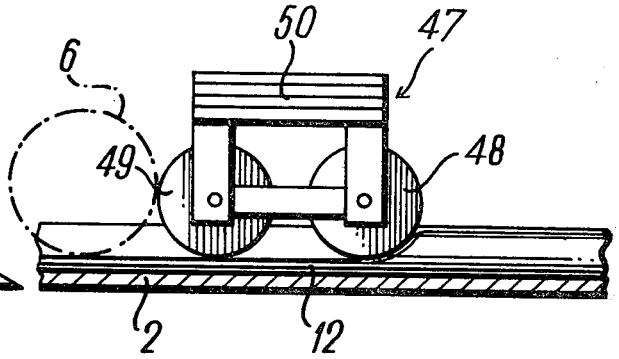
FIG. 4*b* is a sectional view along the line IV*b*-IV*b* in FIG. 4*a;*

According to FIG. 4*a*, the rolling device is not formed by means of a ball, but instead is provided in the form of a travelling carriage 47, which is comprised of two rollers 48 and 49. The rollers carry a support which is loaded with a weight 50. This can be required, for example, if in connection with a particular construction of all other operating parameters the frictional forces of a number of tennis balls being pushed along a channel by the rolling device become relatively large with respect to one another, so that the activation of the tube 12 with air pressure must be correspondingly strong, in order to assure that the rolling device and the tennis balls 6 are driven. This requires further a correspondingly high weight of the rolling device, which then, when it is no longer easy to realize by means of a single ball of heavy material, can be readily realized with the help of such a travelling carriage with its auxilliary weights.

Figure 5A:
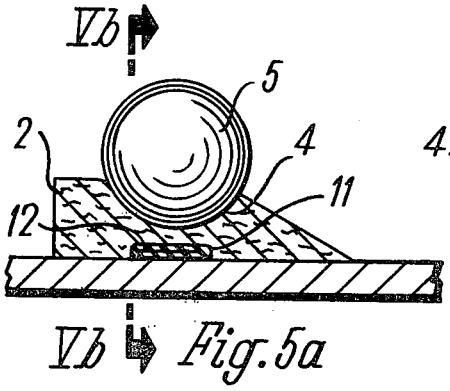
FIG. 5*a* is a cross sectional view through a third embodiment of the channel of the device according to FIG. 1.
Figure 5B:
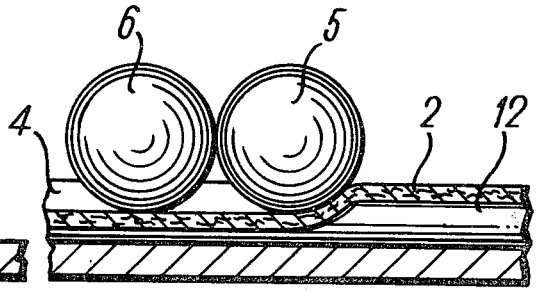
FIG. 5*b* is a cross sectional view along the line v*b*-v*b* in FIG. 5*a;*
Figure 6B:
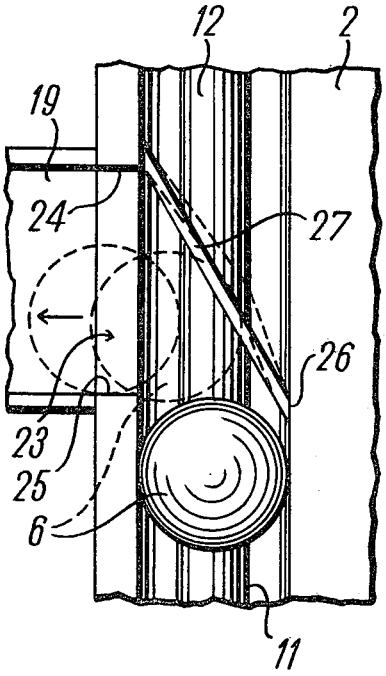
FIG. 6*b* is a top view of the area of the channel illustrated in FIG. 6*a;*

FIGS. 5*a* and 5*b* show the construction of the driving means by arranging the tube 12 in a recess 11 on the underside of the channel 2. The channel 2 itself is thus fabricated from a material which is elastic to the extent that the entire channel in the region of the rolling surface 4 expands when air pressure is introduced into the tube 12, and therefore pushes the ball 5 ahead of it.

What is claimed is:

1. Apparatus for collecting balls from a playing area, comprising a. a channel surrounding at least a portion of said playing area for receiving balls rolling out of said playing area;

b. a device of relatively high weight in comparison to a ball normally used in conventional ball games, said device being capable of rolling transport in said channel;

c. means for driving said rolling device along in said channel, whereby balls received in said channel will also be driven therealong; and d. means for collecting said driven balls.

2. The apparatus as defined by claim 1, wherein said driving means comprises a flexible tube positioned in said channel and means for selectively inflating said tube.

3. The apparatus as defined by claim 2, wherein said channel comprises a concave upper surface for travel of said rolling device and a recess below said concave surface adapted for receiving said tube, said recess being dimensioned so that the tube is pressed closed by said rolling device resting on said concave surface.

4. The apparatus as defined by claim 3, wherein said recess opens into said concave surface.

5. The apparatus as defined by claim 3 wherein there is a layer of elastic material between said channel and said recess and said recess opens toward the underside of said channel.

6. The apparatus as defined by claim 2, wherein said channel comprises an elongated section not containing said tube, said tube terminating at each end position of said section and said apparatus further comprises means attached to each end of said tube at opposite ends of said elongated section for selectively inflating and deflating said tube.

7. The apparatus as defined by claim 1, wherein said ball collecting means comprises at least one ball deposit location and means for transferring balls from said channel to said deposit location.

8. The apparatus as defined by claim 7, wherein said ball transferring means comprises an opening in one side wall of said channel and means for forcing balls being driven along said channel out through said opening.

9. The apparatus as defined by claim 8, wherein said ball forcing means comprises an elastic member positioned obliquely across said channel from the forward side of said opening, in the ball movement direction, rearwardly to the opposite side of the channel, said elastic member having a degree of elasticity and a position within said channel sufficient to force said balls out of said channel but insufficient to disturb movement of said rolling device in said channel

10. The apparatus as defined by claim 7, wherein said apparatus further comprises means selectively operable for propelling collected balls in the direction of said playing area.

11. The apparatus as defined by claim 10, wherein said ball deposit location comprises an indentation, and said ball propelling means is positioned in said indentation.

12. The apparatus as defined by claim 11, wherein said ball propelling means comprises a ball propelling element, a piston connected to said propelling element and means for actuating said piston with air pressure in the direction of said playing area.

13. The apparatus as defined by claim 10, further comprising means positioned remotely from said propelling means for controlling selective operation of said propelling means.

14. The apparatus as defined by claim 13, wherein said control means comprises a switching mechanism connected to said propelling means by electrical conductors and positioned near the boundary of said playing area.

15. The apparatus as defined by claim 13, wherein said control means comprises a radio activatable switching mechanism associated with said propelling means and a portable radio transmitter for activating said switching mechanism.

16. The apparatus as defined by claim 15, wherein said radio transmitter is located in the handgrip of a ball playing racket.

17. The apparatus as defined by claim 16, wherein said racket comprises an elastic cap on said handgrip and a pressure actuating pin connected to said cap and to said transmitter.

18. The apparatus as defined by claim 16, further comprising an antenna for said transmitter in the form of a loop passing around the outside of the racket frame.

19. The apparatus as defined by claim 1, wherein said rolling device is spherical.

20. The apparatus as defined by claim 1, wherein said rolling device comprises a traveling carriage having rollers.

21. The apparatus as defined by claim 20, wherein said traveling carriage is adapted for receiving extra weights.

22. The apparatus as defined by claim 1, wherein said balls are tennis balls.

* * * * *